United States Patent [19]

Fujioka et al.

[11] Patent Number: 4,494,929

[45] Date of Patent: Jan. 22, 1985

[54] CONTINUOUS HEAT TREATMENT FURNACE

[75] Inventors: Masato Fujioka; Katsuyoshi Kobayashi; Koichi Yuta; Nobuyoshi Nishihara, all of Kitakyushu, Japan

[73] Assignee: Nippon Steel Corporation, Tokyo, Japan

[21] Appl. No.: 475,489

[22] Filed: Mar. 15, 1983

[30] Foreign Application Priority Data

Mar. 19, 1982 [JP] Japan ..... 57-42885
Mar. 19, 1982 [JP] Japan ..... 57-42886
Mar. 26, 1982 [JP] Japan ..... 57-47284

[51] Int. Cl.[3] ..... F27B 9/28; C21D 9/52; C21D 9/54

[52] U.S. Cl. ..... 432/59; 266/102; 266/103

[58] Field of Search ..... 432/59; 266/102, 103

[56] References Cited

U.S. PATENT DOCUMENTS 4,165,964 8/1974 Yonezawa et al. ..... 432/59
4,364,728 12/1982 Stamp ..... 266/102

FOREIGN PATENT DOCUMENTS 55-25353 7/1980 Japan .
357575 9/1931 United Kingdom ..... 266/103

*Primary Examiner*—John J. Camby
*Attorney, Agent, or Firm*—Kenyon & Kenyon

[57] ABSTRACT

A continuous heat treatment furnace for heat-treating a metal strip by passing the metal strip continuously through the interior of the furnace, comprising a wall of an air-permeable solid having a three-dimensional skeleton structure or net-like laminate structure satisfying the following requirement:

$$\frac{10}{a_p} < \delta < 300000 \frac{\epsilon^3}{a_p^2}$$

wherein $\delta$ stands for the thickness (m) of the air-permeable solid wall, $a_p$ the specific surface area ($m^2/m^3$) of the air-permeable solid wall, and $\epsilon$ a porosity of the air-permeable solid wall, is arranged between the confronting surfaces of the strip.

11 Claims, 28 Drawing Figures

CONTINUOUS HEAT TREATMENT FURNACE

BACKGROUND OF THE INVENTION

1. Field of the Invention

The present invention relates to a continuous heat treatment furnace for heating a metal strip in a direct fire-heated atmosphere.

2. Description of the Prior Art

In order to prevent surface oxidation at the heating step, it is ordinarily necessary to heat a strip in a reducing atmosphere or an inert gas atmosphere. As the furnace for this heat treatment, there are known an indirect heating furnace using a radiant tube and a direct heating furnace using a direct fire burner. The former furnace is called a radiant tube furnace (RTF), and the latter furnace is called a non-oxidizing furnace (NOF).

The indirect heating method using RTF has been regarded as an excellent means for heating strips because the atmosphere gas can optionally be selected and a high quality product is obtained. However, in order to maintain the air-tightness in the radiant tube, a heat-resistant alloy is ordinarily used as the material for the radiant tube. Therefore, the heating temperature is restricted by the temperature that can be resisted by the tube. Accordingly, this method is defective in that both the heating efficiency and the thermal efficiency are low. Furthermore, the method is defective in that the equipment cost is high.

In contrast, in the direct heating method using NOF, since direct heating is performed by a reducing combustible gas containing unburnt components such as CO and $H_2$ and having an air ratio lower than 1, the heating efficiency and thermal efficiency are high, though the surface conditions of the treated strip are inferior to some extent to those of the strip treated according to the indirect heating method. Moreover, the equipment cost is low. Accordingly this type of furnace has recently been positively adopted for continuous heat treatment furnaces for strips. There are two modes of application of NOF to the continuous heat treatment for strips. According to one mode, NOF alone is used as the heat treatment furnace. According to the other mode, both NOF and RTF are used in combination so as to effectively utilize the characteristics of both the furnaces, and NOF is arranged in the low-temperature region of conventional RTF.

Vertical NOF as one example of the conventional continuous heat treatment furnaces having the above-mentioned characteristics, will now be described with reference to FIGS. 1 and 2.

Referring to FIGS. 1 and 2, reference numeral 101 represents a furnace wall having a sealing property, a fire resistance, and a heat-insulating property, which defines a furnace; reference numeral 102 represents a strip to be heated, which is passed through the interior of the furnace; reference numeral 103 represents a support and delivery roll disposed in the furnace to support and deliver the strip 102; and reference numeral 104 represents a combustion gas supply device arranged on each of both the end portions of the furnace wall 101. Ordinarily, a plurality of combustion gas supply devices 104 are arranged to both the surfaces of the strip 102 in a staggered manner with respect to the thickness direction. A heat treating burner is ordinarily adopted as the combustion gas supply device 104.

Reference numeral 105 represents a sealing chamber for an inlet or outlet for the strip 102; reference numeral 106 represents a roll chamber for protecting the delivery roll 103 for the strip 102 from the high temperature portion; reference numeral 107 represents a heating chamber for heating the strip 102 by the combustion gas supplied from the combustion gas supply device 104; and reference numeral 108 represents a preheating chamber for preheating the strip 102 by the combustion gas from the heating chamber. Ordinarily, a secondary combustion burner is disposed in the preheating chamber 107 to reburn the combustion gas from the heating chamber 107, which contains unburnt components, whereby the thermal efficiency is enhanced. Reference numeral 109 represents a flue for discharging the combustion gas from the furnace. In FIGS. 1 and 2, a solid line indicates the flow of the combustion gas from the outlet to the inlet in the furnace, and a broken line indicates the advancing direction of the strip.

As shown in FIGS. 1 and 2, in the conventional vertical NOF, heating of the strip 2 is accomplished by the gas radiation heat of the combustion gas charged into the furnace from the combustion gas supply device 104 and the solid radiation heat from the peripheral furnace wall 101. Accordingly, in order to increase the quantity of the transfer heat, it is necessary to increase the thickness of the gas layer and the furnace wall area. However, extreme increase of the sectional area of the furnace is restricted by the equipment cost.

Since the temperature of the combustion gas in the preheating chamber 108 is lower than in the heating chamber 107, the convection heat transfer is dominant. Therefore, from the viewpoint of the heat transfer, it is preferred that the sectional area of the furnace be reduced and the flow rate of the combustion gas be increased. In the conventional NOF, however, since all the combustion gas is caused to flow in a counter-current manner to the strip, in view of the pressure loss in the furnace, it is impossible to extremely reduce the sectional area of the furnace.

Furthermore, in the conventional vertical NOF, since the combustion gas is caused to flow in a counter-current manner to the strip 102, the furnace wall 101 should be arranged on both the sides confronting both the surfaces of the strip 102. Therefore, the furnace should be constructed to have a long shape bent in the vertical direction in such a manner that the strip advancing line is surrounded by the furnace wall 101, as shown in FIGS. 1 and 2. Accordingly, the furnace installation area is increased and the furnace wall area is increased. The conventional vertical NOF thus involves a fundamental problem of increased equipment cost.

SUMMARY OF THE INVENTION

It is a primary object of the present invention to solve the above-mentioned problems of the conventional vertical continuous heat treatment furnace and provide a continuous heat treatment furnace having such a structure as will provide a high heat transfer efficiency.

Another object of the present invention is to provide a continuous heat treatment furnace in which the furnace body is made more compact than in the conventional furnace, that is, the furnace length is shortened and the furnace wall area is reduced, with the result that the equipment cost can be reduced.

The heat treatment furnace attaining the foregoing objects according to the present invention is characterized in that the furnace body is constructed to have a simple case-like shape, a strip is passed through the interior of the furnace body, and an air-permeable solid excellent in the heat transfer-promoting effect and the heat response is utilized for attaining an effective heat transfer to the strip in the furnace and increasing the effect of a partition wall in the furnace.

BRIEF DESCRIPTION OF THE DRAWINGS

In the drawing:

FIGS. 8A–8D are diagrams of an example of the structure of the furnace used when the temperature of the combustion gas is low (1000° C. or below), in which FIG. 8A is a front view, FIG. 8B is a view of the section taken along the line B—B in FIG. 8A, FIG. 8C is a view of a part C in FIG. 8B, and FIG. 8D is a view of the section taken along the line D—D in FIG. 8A;

FIG. 9A–9D are diagrams of an example of the structure of the furnace used when the temperature of the combustion gas is high (higher than 1000° C.), in which FIG. 9A is a front view, FIG. 9B is a view of the section taken along B—B in FIG. 9A, FIG. 9C is a view of the section taken along the line C—C in FIG. 9A, and FIG. 9D is a view of a part D in FIG. 9B;

DESCRIPTION OF THE PREFERRED EMBODIMENTS

Figure 1:
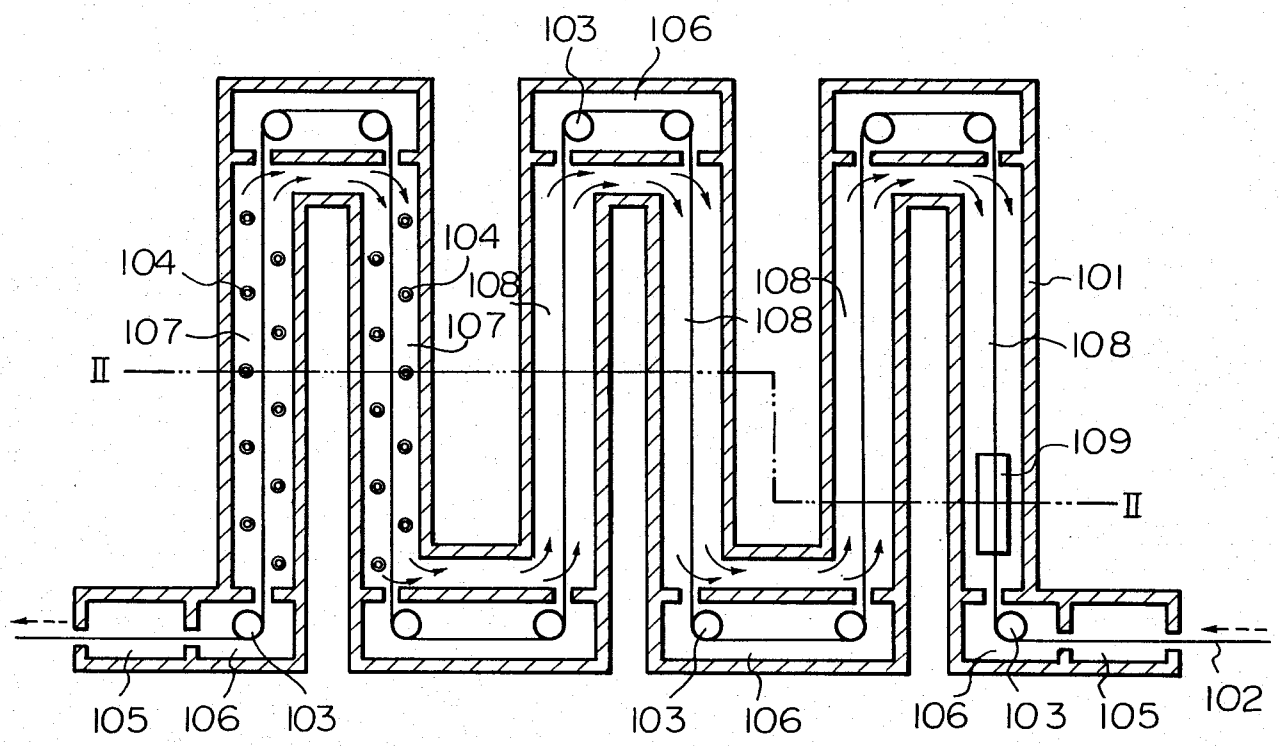
Fig. 1 PRIOR ART
FIG. 1 is a longitudinal section of the conventional vertical continuous heat treatment furnace.
Figure 2:
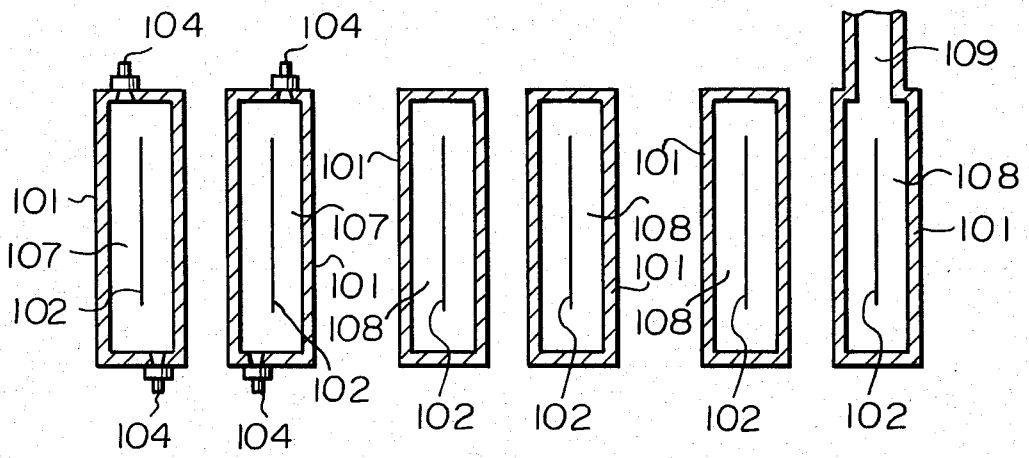
Fig. 2 PRIOR ART
FIG. 2 is a cross-section taken along the line II—II in FIG. 1.

By the term "air-permeable solid" used herein is meant a porous material having a three-dimensional skeleton structure having an air permeability and showing an appropriate pressure difference between the gas at the inlet and the gas at the outlet when the gas is passed through this air-permeable solid. As the air-permeable solid, there can be mentioned metal solids such as foamed metals and sintered metals and refractory solids such as ceramic porous bodies, porous SiC, and alumina ball bonded bodies.

Properties of a ceramic foam (supplied by Bridgestone Tire Co., Ltd.) as one example of the air-permeable solid are shown in Table 1.

TABLE 1

| Kind | Code number | Number of pores per inch | Specific surface area $a_p$ ($m^2/m^3$) | Porosity $\epsilon$ |
|---|---|---|---|---|
| Ceramic foam | #06 | 6 | 750 | 0.87 |
| Ceramic foam | #13 | 13 | 1200 | 0.87 |
| Ceramic foam | #20 | 20 | 2400 | 0.88 |
| Ceramic foam | #30 | 30 | 3600 | 0.88 |

Since an air-permeable solid of this type is porous, the phenomenon of the transfer of heat between the air-permeable solid and the passing gas is quite similar to the heat transfer through a layer packed with powder. If the corresponding diameter of the three-dimensional net-like skeleton structure of the air-permeable solid is about 0.01 to about 2 mm, a large convection heat transfer coefficient as $10^2$ to $10^4$ kcal/$m^2$h° C. is obtained. Therefore, the surface temperature of the air-permeable solid wall on the gas inlet side is instantaneously elevated to a level very close to the gas temperature. Accordingly, the solid radiant heat transfer from the air-permeable solid greatly increases the heat transfer quantity over the heat transfer quantity in the conventional furnace.

The heat transfer behavior of the air-permeable solid will now be described in detail. The convection heat transfer phenomenon in the air-permeable solid is very similar to the heat transfer through a powder-packed layer. The heat transfer quantity is expressed by the following $$q = h_p a_p \delta A(tg - ts) \quad (1)$$

wherein q stands for the quantity (kcal/h) of heat transferred by convection from the passing gas to the air-permeable solid, $h_p$ stands for the convection heat transfer coefficient (kcal/$m^2$h° C.) (per the surface area of the net-like skeleton of the air-permeable solid), $a_p$ stands for the specific surface area ($m^2/m^3$) of the air-permeable solid, A stands for the sectional area ($m^2$) (the area of the section rectangular to the flow direction of the passing gas), $\delta$ stands for the thickness (m) of the air-permeable solid (the thickness in the flow direction of the passing gas), tg stands for the temperature (° C.) of the passing gas, and ts stands for the temperature (° C.) of the air-permeable solid.

As is apparent from the formula (1), as the specific surface area $a_p$ and thickness $\delta$ of the air-permeable solid are large, the heat transfer quantity q becomes large.

In order to heat an article, the radiant heat transfer quantity from the air-permeable solid to the article to be heated should be large. Because of radiation characteristics, the larger the surface area of the air-permeable solid, the larger the radiant heat transfer quantity from the air-permeable solid to the article to be heated. Accordingly, as the value of the product $a_p\delta$ of the specific surface area $a_p$ and thickness $\delta$ of the air-permeable solid, which represents the surface area of the net-like skeleton per the gas-passing sectional area A of the air-permeable solid, is large, the radiant heat transfer quantity is increased. Although the radiant heat from the surface of air-permeable solid arrives at the article to be heated, the radiant heat generated in the interior of the air-permeable solid is blocked by the air-permeable solid per se. Therefore, even if the value $a_p\delta$ is increased beyond a certain level, the ratio of increase of the radiant heat transfer quantity is gradually reduced. In contrast, if the value $a_p\delta$ is reduced below a certain level, the state in which see-through holes extending from the front side to the back side are formed is brought about in the solid air-permeable solid, and the radiant heat transfer area is reduced, resulting in reduction of the heat transfer quantity. Based on these findings, we examined the heat transfer characteristics of air-permeable solids by experiments. Results of these experiments will now be described.

Figure 3:
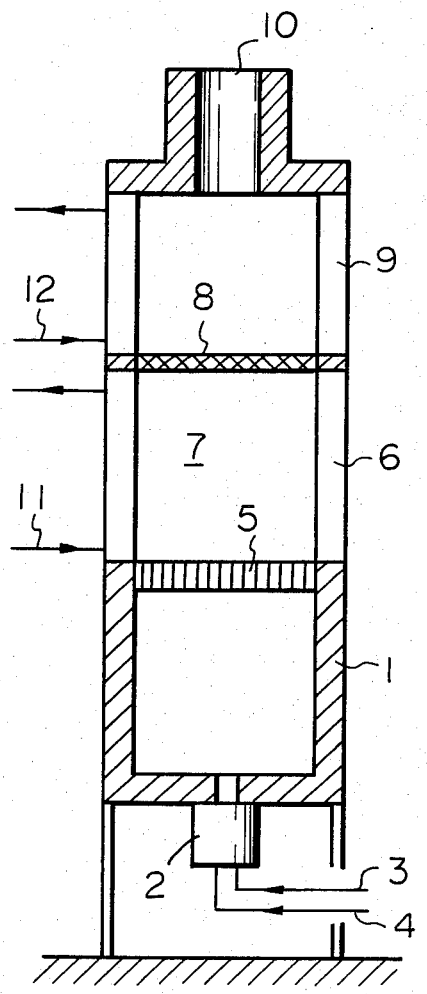
FIG. 3 is a diagram of the experiment apparatus for measuring heat transfer characteristics of air-permeable solids.

FIG. 3 illustrates an experimental apparatus used for examining the heat transfer characteristics of air-permeable solids. Referring to FIG. 3, reference numeral 1 represents a combustion chamber defined by a refractory wall. Fuel gas and air are supplied to a burner 2 through a fuel supply pipe 3 and an air supply pipe 4, respectively, and the fuel gas is burnt in the combustion chamber 1. The combustion gas passes through a commutating plate 5 composed of a refractory and flows into a heat transfer chamber 7 surrounded by a cooling chamber 6. The combustion gas passes through an air-permeable solid 8 from the heat transfer chamber and is finally discharged from the apparatus through an exhaust hole 10. The chambers before and after the air-permeable solid 8 are surrounded by the cooling chambers 6 and 9. Each cooling chamber is a jacket formed on a heat-resistant steel plate and air is caused to flow in the jacket from cooling air pipes 11 and 12. The flow amount of cooling air and the temperatures at the inlet and outlet are measured to determine the quantity of the heat transfer to the cooling chamber. The cooling chamber 6 has an inner diameter of 300 mm and a height of 300 mm. The quantity of the combustion gas produced by the burner 2 is 20 to 150 $Nm^3/H$, and the temperature of the combustion gas at the inlet portion of the heat transfer chamber 7 is 1000° C. to 1400° C.

Figure 4:
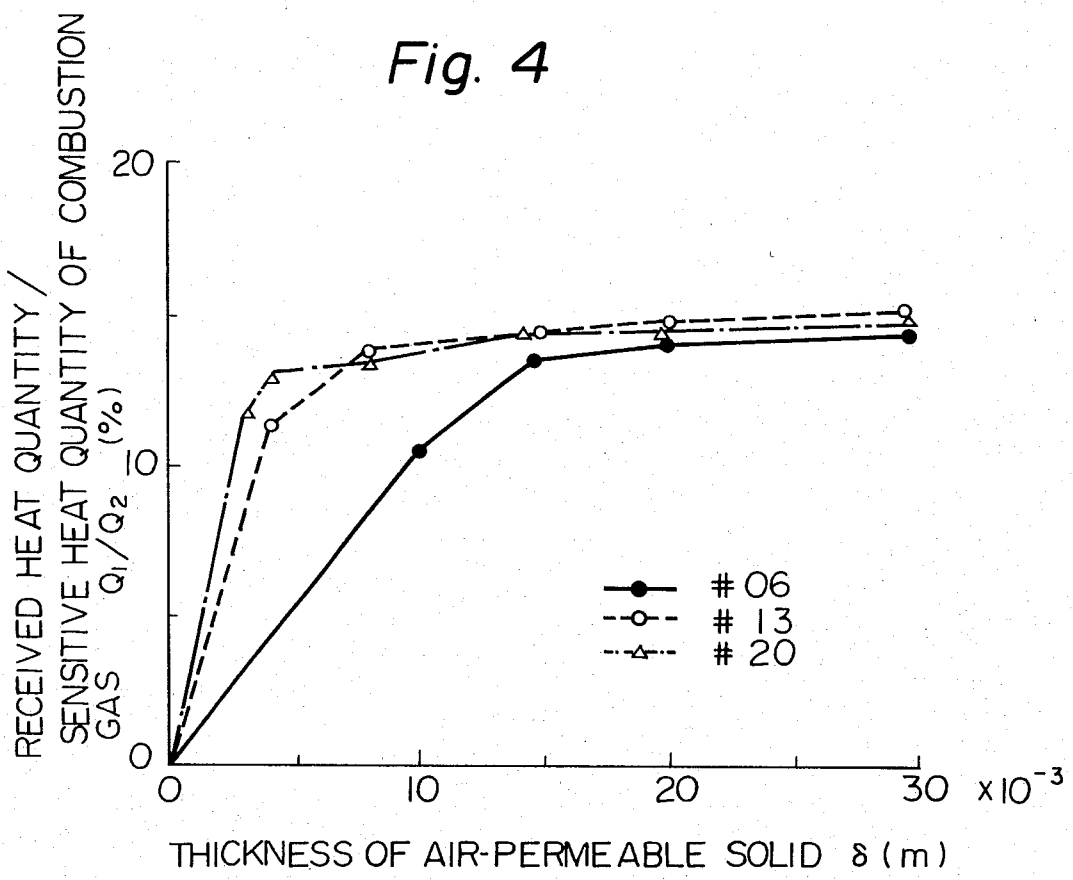
FIG. 4 is a graph of results of the measurement of heat transfer characteristics of air-permeable solids.

FIG. 4 shows results obtained at an example of the measurement. The amount of the combustion gas passing through the air-permeable solid is about 30 $Nm^3/H$ and the temperature of the combustion gas at the inlet portion of the heat transfer chamber 7 is 1350° C. Ceramic foams #06, #13, and #20 shown in Table 1 are used as the air-permeable solid, and the thickness $\delta$ of the air-permeable solid is 0.003 to 0.03 m. Under the above conditions, the quantity $Q_1$, of heat received in the cooling chamber 6 is determined. The value $Q_1$, corresponds to the sum of the solid radiation from the air-permeable solid and the gas radiation in the heat transfer chamber. The latter radiation is subtracted by calculation to obtain a transfer heat quantity $Q_1$ from the air-permeable solid. In FIG. 4, the ordinate indicates the ratio (%) of $Q_1$ to the sensible heat $Q_0$ of the combustion gas flowing into the heat transfer chamber, and the abscissa indicates the thickness $\delta$ of the air-permeable solid used. As is seen from FIG. 4, increase of the thickness $\delta$ of the air-permeable solid results in increase of the heat transfer ratio $Q_1/Q_0$. The smaller the thickness $\delta$, the larger the rate of increase of the heat transfer ratio $Q_1/Q_0$. If the thickness $\delta$ exceeds a certain level, the increase rate is reduced. More specifically, in case of ceramic foams #06, #13, and #20, if the thickness values $\delta$ are up to 0.015 m, 0.008 m, and 0.004 m, respectively, the heat transfer ratio $Q_1/Q_0$ is abruptly increased. Accordingly, a very high heat transfer effect is attained if the air-permeable solid is used in a thickness exceeding this critical value. The obtained results are summarized in Table 2. As is seen from Table 2, the value of $\delta \times a_p$ is 10 to 11 and substantially constant when the thickness $\delta$ is the above-mentioned critical value. This tendency is similarly observed even if the gas speed and temperature are changed.

TABLE 2

| | $a_p$ ($m^2/m^3$) | $\delta$ (m) | $a_p\,\delta$ ($m^2/m^2$) |
|---|---|---|---|
| #06 | 750 | 0.015 | 11 |
| #13 | 1200 | 0.008 | 10 |
| #20 | 2400 | 0.004 | 10 |

From the above experimental results, it is seen that the relation of $$\delta > \frac{10}{a_p}$$

should be established between the thickness $\delta$ of the air-permeable solid and the specific surface area thereof so as to attain a high heat transfer effect. The physical property condition of $$\delta > \frac{10}{a_p}$$

for the air-permeable solid, confirmed by the experiments, is different from the condition for known radiant heat transfer means such as a metal net used for a petroleum stove. In case of a metal net for a petroleum stove or the like, the back side can be seen from the front side through net meshes and the radiant heat transfer area is very small. Therefore, the required condition is $$\delta << \frac{10}{a_p},$$

which is quite different from the physical property condition confirmed by us based on experiments. More specifically, according to the present invention, by using a very small air-permeable solid having a net-like skeleton having a corresponding diameter of about 0.01 to about 2 mm and maintaining a certain thickness $\delta$, a very large specific surface area of the air-permeable solid is utilized and a very high heat transfer efficiency is obtained. The physical property condition of $$\delta > \frac{10}{a_p}$$

constituting the essence of the present invention is based on an experimentally found new fact obtained as the result of the research made with a view to improving the heat transfer efficiency. Therefore, the present invention is very valuable from the industrial viewpoint and is fundamentally different from the known techniques.

The pressure loss of the gas passing through the air-permeable solid is increased with increase of the thickness $\delta$ and specific surface area $a_p$ of the air-permeable solid. When the air-permeable solid is arranged in the furnace, the commutating effect is produced by the pressure loss of the passing gas and the gas flow in the furnace is uniformalized. In an industrial furnace, the gas flow is not always uniform and drifts are formed according to the arrangement of burners, the type of the furnace, the position of the flue, and the buoyancy of the heated gas. Accordingly, deviation of the heating temperature and reduction of the heating efficiency are caused. However, this disadvantage is moderated in the present invention by the effect of commutating the gas flow in the furnace by the air-permeable solid, and the heating efficiency can be improved. The larger the pressure loss, the higher this improving effect. However, in an industrial furnace, if the pressure loss of the combustion gas is increased, the pressure in the furnace is increased and a problem arises in connection with sealing of the opening of the furnace. Furthermore, if discharge of the exhaust gas is performed by a suction blower, when the pressure loss of the combustion gas is increased, the capacity of the blower should be increased. If the exhaust gas is discharged by the ventilating force of a chimney, it is necessary to increase the height of the chimney. For these reasons, the thickness $\delta$ and specific surface area $a_p$ of the air-permeable solid should be limited below certain values.

In a heating apparatus such as a metal heating furnace or a heat treatment furnace, the heat load in the combustion chamber (the combustion quantity per the inner volume of the furnace) is ordinarily $10\times10^4$ to $40\times10^4$ kcal/m$^3$h, and this value is converted to a combustion exhaust gas quantity of 100 to 400 Nm$^3$/m$^3$h. Supposing that a combustion exhaust gas is passed through an air-permeable solid arranged along the wall of a furnace having a cubic shape as a model furnace, the flow rate of the passing gas is 0.02 to 0.1 Nm/S (the value differs according to whether the air-permeable solid is arranged on one face or six faces). Since the pressure in the furnace is 1 to 3 mm Aq in an ordinary heating apparatus, when the air-permeable solid is arranged, the allowable pressure loss of the air-permeable solid is 3 mm Aq or less. In order to determine an appropriate thickness of the air-permeable solid satisfying the foregoing conditions, the pressure loss characteristics of air-permeable solids were measured by using the above-mentioned experimental apparatus.

Figure 5:
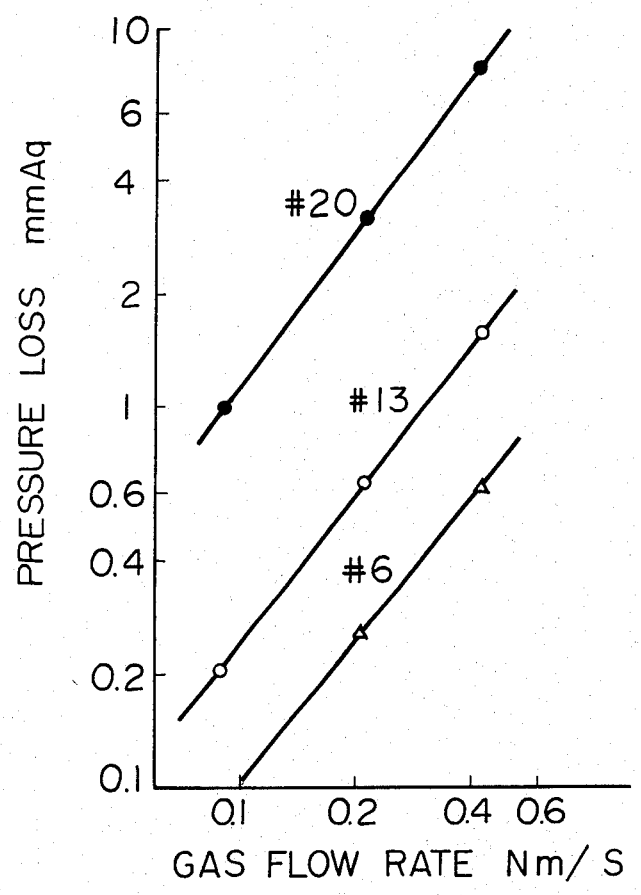
FIG. 5 is a graph of the results of the measurement of pressure losses in gases passed through air-permeable solids.

FIG. 5 shows the results of the measurement of the pressure loss in air-permeable solids. The experimental conditions are an air-permeable solid thickness $\delta$ of 0.010 m and a passing gas temperature of 1000° C. Ceramic foams #06, #13, and #20 are used as the air-permeable solid. The allowable thickness $\delta$ of the air-permeable solid to be applied to an industrial furnace was examined based on the experimental results to obtain results shown in Table 3. In a practical furnace, it is necessary that the pressure loss of the passing gas be smaller than 3 mm Aq at a passing gas flow rate of 0.1 Nm/S. For satisfying this condition, as is seen from Table 3, the allowable thickness $\delta$ of the air-permeable solid should be 0.33 m for #06, 0.13 m for #13, and 0.03 m for #20. It is known that the pressure loss in a packed layer is substantially proportional to $a_p^2\times\delta$ and is in inverse proportion to the cube of the porosity $\epsilon$. The same holds good with respect to the pressure loss in the air-permeable solid. For the foregoing reasons, the value of $a_p^2\delta/\epsilon^3$ is determined under the foregoing conditions shown in Table 3, and it is seen that a constant value of $30\times10^4$ is obtained in each case. Accordingly, when an air-permeable solid is arranged in an industrial furnace, in order to maintain the pressure loss of the passing gas to a level not causing any practical trouble, it is ordinarily necessary that the condition of $$\delta < \frac{300000\epsilon^3}{a_p^2}$$

be satisfied.

TABLE 3

| | Specific surface Area $a_p$ (m$^2$/m$^3$) | Allowable Thickness* $\delta$ (m) | Porosity $\epsilon$ | Pressure loss $a_p^2\,\delta/\epsilon^3$ (l/m) |
|---|---|---|---|---|
| #06 | 750 | 0.33 | 0.87 | $30\times10^4$ |
| #13 | 1200 | 0.13 | 0.87 | $30\times10^4$ |
| #20 | 2400 | 0.03 | 0.88 | $30\times10^4$ |

Note:
*: $\delta$ stands for the thickness of the air-permeable solid when the pressure loss of the passing gas is 3 mm Aq (the passing gas temperature is 1000° C. and the flow rate of the passing gas is 0.1 Nm/S).

As is apparent from the foregoing description, when an air-permeable solid is arranged in a heating apparatus, if the relation of $$\frac{10}{a_p} < \delta < 300000\frac{\epsilon^3}{a_p^2}$$

is established between the thickness $\delta$ (m) and specific surface area $a_p$ (m$^2$/m$^3$) of the air-permeable solid, the heat transfer efficiency can be improved, the gas flow in the furnace can be commutated, and the pressure loss due to the air-permeable solid is controlled within a practically allowable range.

When an air-permeable solid having the above-mentioned characteristics is practically applied to a vertical continuous heat treatment furnace, according to the present invention, a wall of the air-permeable solid is arranged at least between the confronting faces of a strip (between two adjacent paths) in the furnace where a plurality of paths are formed. When this wall of the air-permeable solid is arranged, the combustion gas fed from the combustion chamber located on the outlet side of the furnace passes through the wall of the air-permeable solid in the form of a uniform flow. In this case, the temperature of the wall surface on the upstream side of the wall of the air-permeable solid is substantially instantaneously elevated to the level of the gas temperature on the upstream side and the strip confronting the wall surface is heated by the radiant heat. The temperature of the wall surface on the downstream side of the air-permeable solid is determined according to the heat balance between the quantity of the radiant heat on the upstream side of the wall of the air-permeable solid and the quantity of the heat of the combustion gas passing through the wall of the air-permeable solid. The strip is also heated by the radiant heat from the wall surface on the downstream side of the wall of the air-permeable solid. Accordingly, the heat transfer efficiency and heating efficiency of the furnace are remarkably improved, and a plurality of paths for the strip in the furnace can be brought near to one another to such an extent that the strip-passing operation is not disturbed, with the result that the furnace can be made compact.

One or a plurality of walls of the air-permeable solid may be arranged. This wall may also be arranged between the strip and the furnace wall. Furthermore, in addition to the combustion gas supply device arranged on the outlet side and the exhaust gas flue on the inlet side, another combustion gas supply device and another flue, optionally together with an air supply device may be arranged at intermediate positions.

In a vertical continuous heat treatment furnace for strips, it sometimes happens that a strip is broken. In this case, there is a risk of damage of the air-permeable solid by the broken strip. Since the air-permeable solid does not have a strength sufficient to resist an external force by the broken strip or the like, special care should be taken to the structure of the furnace in which the air-permeable solid is arranged.

In view of the foregoing, in a direct heating non-oxidizing furnace, the present invention provides a specific structure in which (1) the heat transfer efficiency is increased to attain an energy-saving effect and (2) the installation length of the heat transfer surface of NOF is shortened to reduce the equipment cost. More specifically, the present invention provides a structure of a wall of an air-permeable solid arranged over an area exceeding 65% of the total gas passing area in NOF, where the wall of the air-permeable solid is effectively supported and the strength against an external force by a broken strip or the like is enhanced. The specific structure of the present invention comprises a split type air-permeable solid wall, a supporting pipe, a protector, and an air-permeable solid-supporting frame.

Embodiments of the heat treatment furnace according to the present invention will now be described in detail.

Figure 6:
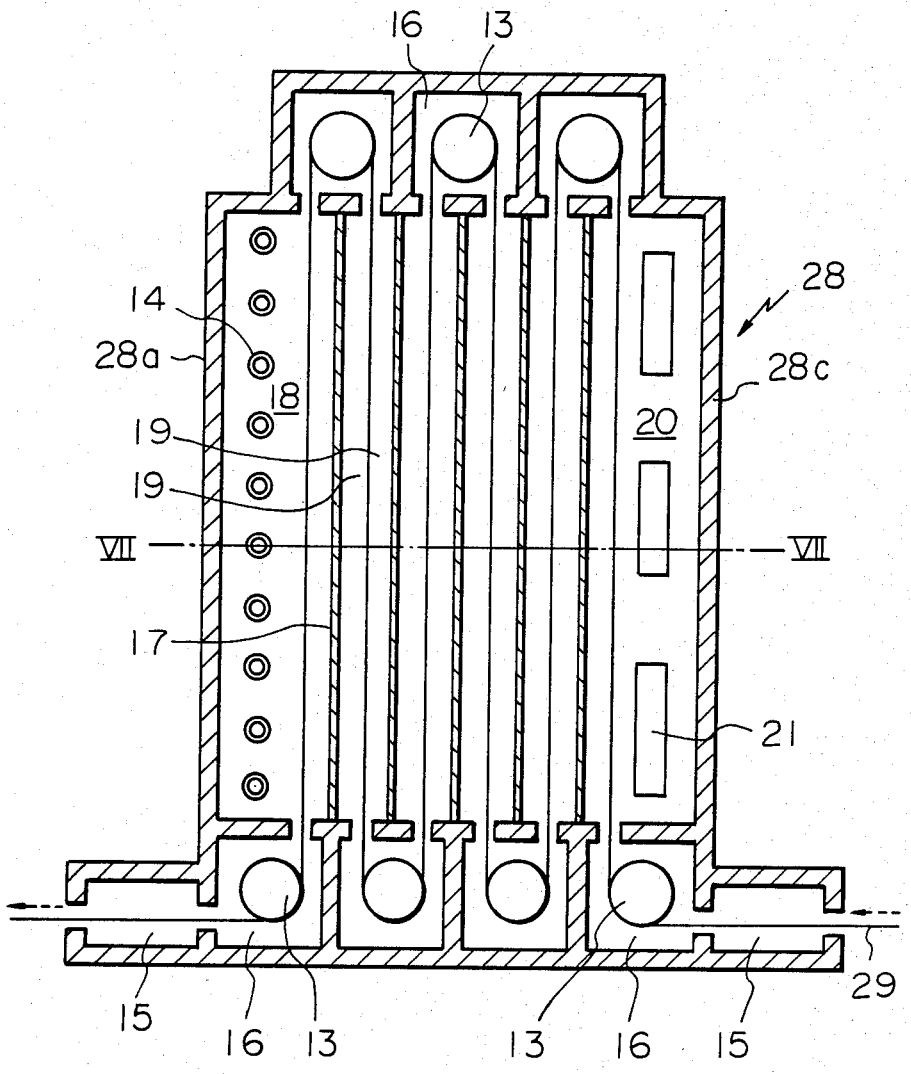
FIG. 6 is a longitudinal sectional view of a fundamental embodiment of the vertical continuous heat treatment furnace.
Figure 7:
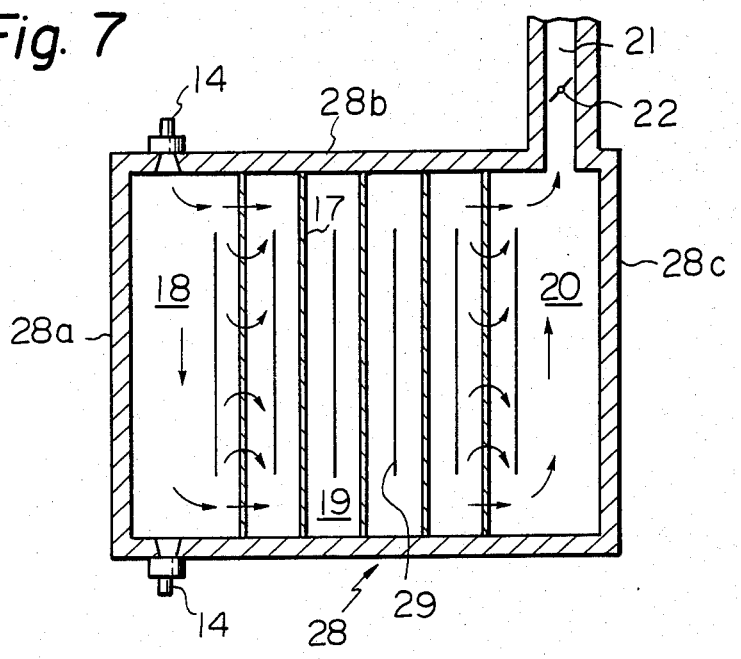
FIG. 7 is a cross-section taken along the line VII—VII in FIG. 6.

FIGS. 6 and 7 show a typical instance of the vertical heat treatment furnace according to the present invention. As shown in the drawings, the furnace body 28 is different from a conventional split type furnace and is formed in one case by wall bricks having a sealing property, a refractory property, and a heat resistance, and an inlet sealing chamber 15*a* is formed in the lower portion of one end of the furnace body 28 and an outlet sealing chamber 15*b* is formed in the lower portion of the opposite end. A plurality of roll chambers for containing and protecting support and delivery rolls 13 for a strip 29 introduced into the furnace are integrally formed in the upper and lower portions of the interior of the furnace body 28. As shown in the drawings, the strip 29 is guided by the rolls 13 in the furnace and is delivered while forming a plurality of paths. The distance between two adjacent paths is determined while the adaptability to the strip-passing operation and the manner of the arrangement of the air-permeable solid wall described hereinafter are taken into consideration.

At an intermediate position between the strip 29 and the furnace wall 28*a* on the outlet side (high temperature side) of the strip 29, a plurality of combustion gas supply devices 14 are arranged. As the combustion gas supply device 14, there may be used, for example, a heat treatment burner confronting the side wall 28*b* in the lateral direction of the strip as shown in FIG. 7. Of course, a combustion gas formed by combustion outside the furnace can be supplied, and combustion gas supply devices 14 may be arranged on the furnace wall confronting the strip 29.

According to the present invention, in the furnace body having the above-mentioned structure, a partitioning wall 17 of the air-permeable solid is arranged between confronting surfaces of the strip 29 so that the interior of the furnace is divided in desirable zones, for example, a combustion chamber 18 defined by the furnace wall 28*a* on the strip discharge side and the air-permeable solid wall 17, a subsequent heating chamber 19 defined by the air-permeable solid wall 17 arranged between the confronting surfaces of the strip 29 and the furnace side wall in the lateral direction of the strip, and a subsequent exhaust gas chamber 20 defined by the furnace wall on the strip introduction side and the air-permeable solid wall 17. An exhaust flue 21 is formed in the exhaust gas chamber 20 and a flow rate adjusting valve 22 is arranged in the flue 21.

Figure 8B:
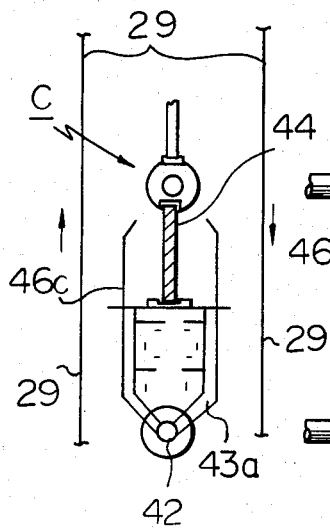
Figure 8A:
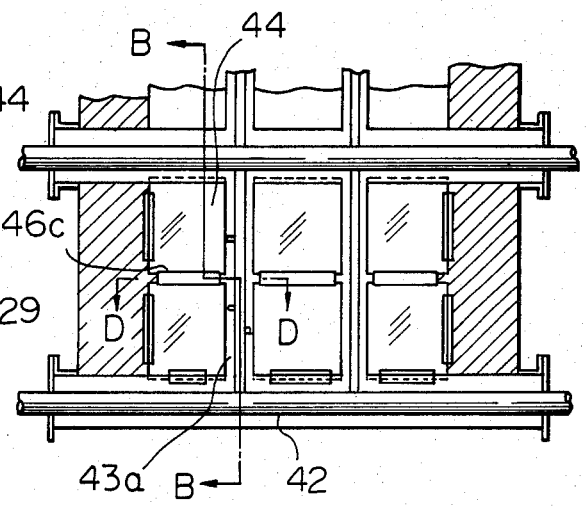
Figure 8C:
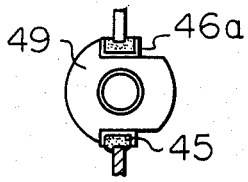
Figure 8D:
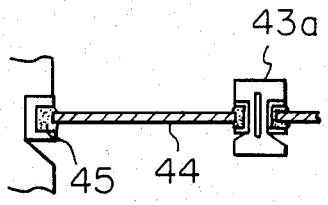
Figure 9B:
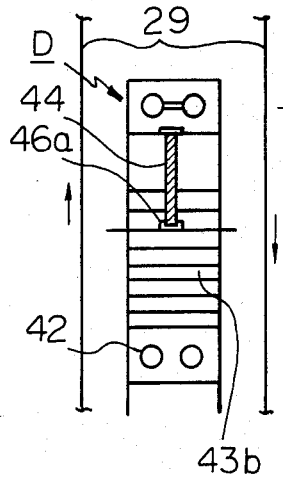
Figure 9A:
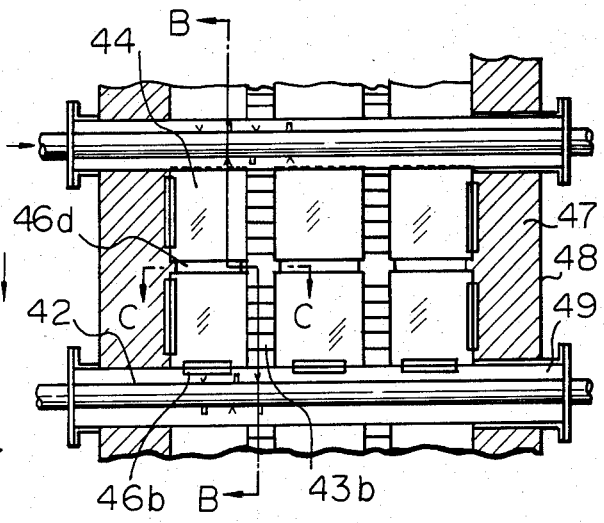
Figure 9C:
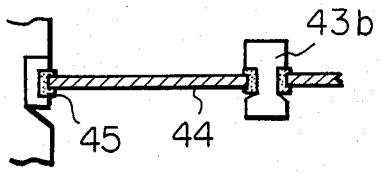
Figure 9D:
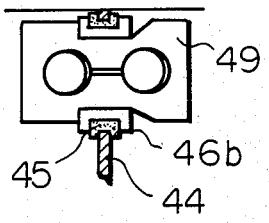
Figure 10:
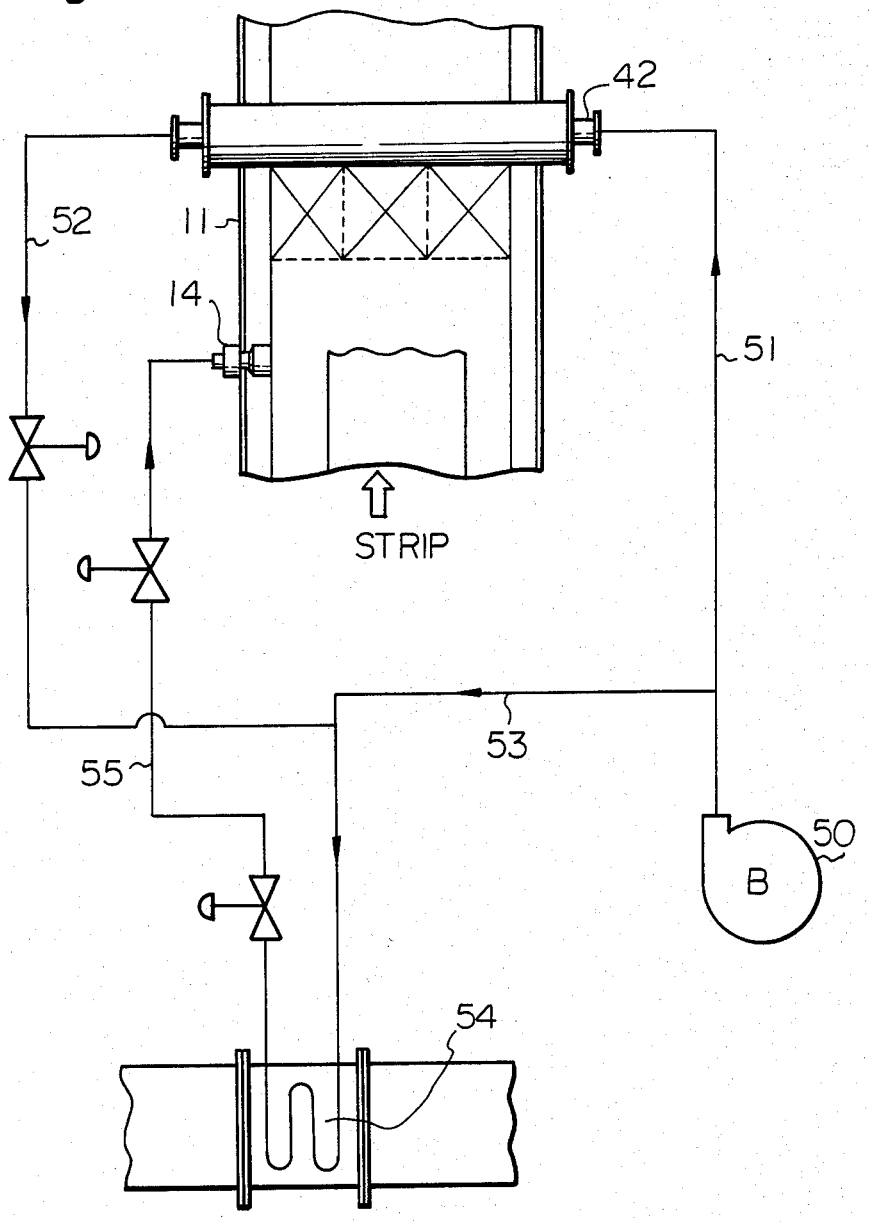
FIG. 10 is a schematic view of one preferred embodiment of the furnace of the present invention.

In accordance with a preferred embodiment of the present invention, as shown in FIG. 8A to 8D, in order to support the air-permeable solid and propagate an external force by a broken strip or the like to a furnace shell fitting as a strength member for the furnace body, main supporting members such as supporting pipes 42 are horizontally arranged at predetermined intervals in the direction of the height. This pipe 42 has in a high-temperature atmosphere a flexural rigidity sufficient to resist the weight of a refractory lined on the outer surface of the pipe 42 and a strength sufficient to resist an external force by breakage of the strip 29. The supporting pipe 42 is supported by the furnace shell fitting and the outer surface of the supporting pipe 42 is lined with a refractory 49. Since a sufficient impact strength is required for this supporting pipe 42 with a small diameter, a good effect can be obtained when a metal pipe is used as the supporting pipe 42. It is preferred that the metal pipe 42 be cooled by causing air to flow on the inner surface of the pipe as shown in FIG. 10. In this case, as shown in FIG. 10, normal temperature air is supplied to the supporting pipe 42 (see FIGS. 8A and 8B) through a line 51 from a blower 50 and heat is removed from the supporting pipe 42 kept in the high temperature atmosphere and air is discharged through a line 52. Air fed through a line 52 from the blower 50 and preheated by a heat exchanger 54 is supplied to the combustion gas supply device 14 (see FIG. 6) arranged on the furnace body 28 through a line 55. If air depriving the supporting pipe 42 of heat is introduced into normal temperature air in the line 53 before the heat exchanger 54, air in the line 53 can be preheated and the heat loss in the supporting pipe 42 can be recovered. Furthermore, air for combustion may be utilized as cooling air. For example, as the supporting pipe 42, a single pipe structure as shown in FIG. 8C or a pair of connected pipes as shown in FIG. 9D may be adopted.

In order to prevent the broken strip 29 from damaging the air-permeable solid irrespective of the width of the strip 29, protectors 43*a* and 43*b* for protecting the air-permeable solid 44 are arranged at predetermined intervals in the longitudinal direction of the pipe 42. As shown in FIGS. 8A to 8D, in the region where the temperature of the passing combustion gas is low (below 1000° C.), a heat-resistant steel 43*a* having the outer surface thereof covered with a refractory is used as the protector. As shown in FIGS. 9A to 9D, in the region where the temperature of the combustion gas is high (above 1000° C.), a refractory brick 43*b* is arranged as the protector. Grooves may be formed on the protector to support the air-permeable solid 44. In this case, the protector acts also as a supporting frame.

A frame 46 for supporting the air-permeable solid 44 by the supporting pipe 42 is arranged in the intermediate portion. In the region where the temperature of the combustion gas is low (below 1000° C.), a metal frame 46*a* and/or formed ceramic fiber is used as the frame 46. In the region where the temperature of the combustion gas is high (above 1000° C.), a refractory brick 46*b* and/or ceramics and/or formed ceramic fiber is used as the frame 46. Each of the frames is shaped to have grooves inclined on one side so that when the air-permeable solid 44 is broken, it can easily be exchanged.

In order to prevent the impact load at the breakage of the strip from acting on the air-permeable solid 44 through the supporting pipe 42 and prevent breakage of the air-permeable solid due to the difference of thermal deformation between the frame 46 and the air-permeable solid 44, a shock absorber 45 is inserted between the air-permeable solid 44 and the frame 46. Furthermore, in order to prevent mutual influences of the air-permeable solids 44 at the time of thermal deformation, frames 46*c* and 46*d* are placed in the joint portion between the air-permeable solids 44. Incidentally, reference numerals 47 and 48 represent a furnace shell and a refractory heat-insulating member, respectively.

The operation of the apparatus of the present invention having the above-mentioned structure will now be described.

The combustion gas supplied to the combustion chamber 18 from the combustion gas supply device 14 is passed through the heating chamber 19, exhaust gas chamber 20, and flue 21 and is discharged outside the furnace, as indicated by solid lines in FIG. 7. In this case, since each air-permeable solid wall 17 has an appropriate pressure loss, the combustion gas filled in a space above each air-permeable solid wall 17 passes through each solid wall 17 in the form of a substantially uniform flow.

Furthermore, the air-permeable solid wall 17 has a large convection heat transfer coefficient as one characteristic property, the surface temperature of the air-permeable solid wall 17 on the upstream side is substantially instantaneously elevated to a level close to the gas temperature on the upstream side, and, therefore, the strip 29 confronting the surface of the air-permeable solid wall 17 is heated by the solid radiant heat from the wall 17.

The surface temperature of the air-permeable solid wall 17 on the downstream side is determined by the heat balance between the radiant heat transfer quantity on the upstream side of the air-permeable solid wall 17 and the heat of the combustion gas passing through the air-permeable solid wall 17. The strip 29 confronting the air-permeable solid wall 17 on the downstream side is heated by the radiant heat transfer from the wall 17.

Accordingly, when the furnace of the present invention is adopted, by passing the strip 29 in a plurality of paths arranged in the heating chamber 19 in the vertical direction, the strip 29 can be heated at a high efficiency.

As is apparent from the foregoing description, a single air-permeable solid wall or a plurality of air-permeable solid walls are aligned between the confronting surfaces of the strip and the combustion gas is caused to flow vertically to the strip and the air-permeable solid walls. The heat treatment furnace of the present invention having this structure is advantageous and characteristic in the following points over the conventional heat treatment furnace in which the combustion gas is caused to flow in a counter-current manner to the strip.

(1) Since the combustion gas flows vertically to the strip, the installation area of the furnace and the wall surface area of the furnace can be reduced, with the result that the furnace can be made compact and the equipment cost can be reduced.

(2) Since the air-permeable solid wall is arranged between the confronting surfaces of the strip and the combustion gas is caused to flow vertically to a plurality of air-permeable solid walls, the flow rate of the gas passing through the plurality of the air-permeable solid walls can be increased. Hence, the surface temperature of the air-permeable solid walls can be maintained at a high level, with the result that the heat transfer quantity to the strip can be increased over that in the conventional furnace.

(3) Since the air-permeable solid wall has a good heat inertia (heat response), breakage of the strip due to an overshoot phenomenon of the strip temperature by trouble in the line (speed reduction, stoppage, or the like) can be inhibited, with the result that the frequency of stoppage of the line is decreased and the operation efficiency is increased.

(4) Since the air-permeable solid can stably be attached, the wall of the air-permeable solid can be protected from an external force by the breakage of the strip and occurrence of operation troubles can be reduced.

The foregoing embodiments are fundamental embodiments of the present invention. The present invention includes many other embodiments and modifications, for example, those described below.

Figure 12:
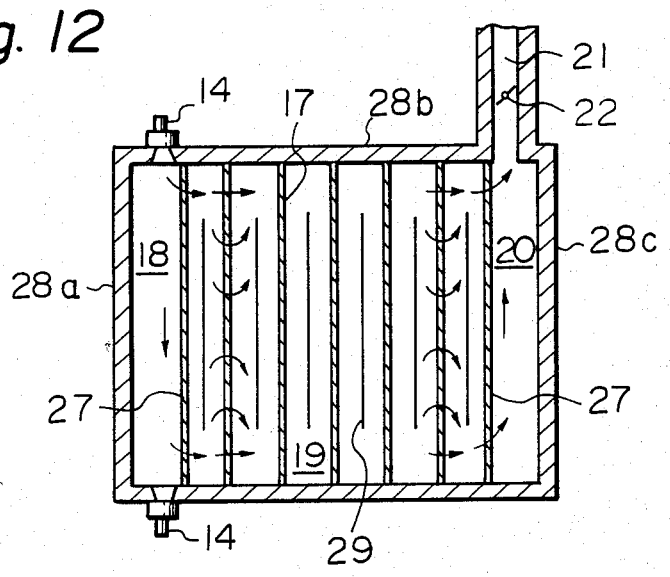
FIGS. 12, 14, 16, 18, and 20 are cross-sectional views of the embodiments illustrated in FIGS. 11, 13, 15, 17, and 19, respectively.
Figure 11:
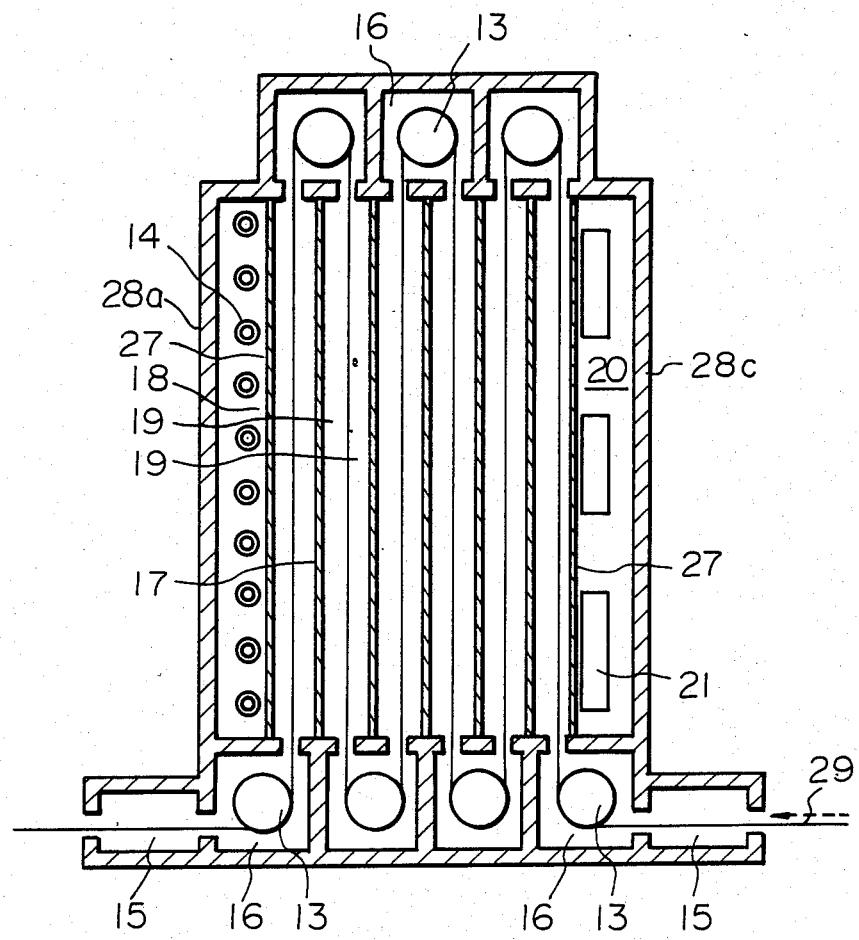
FIGS. 11, 13, 15, 17, and 19 are longitudinal sectional views of other embodiments of the furnace of the present invention.

In the embodiment illustrated in FIGS. 11 and 12, in addition to an air-permeable solid wall arranged between the confronting surfaces of the strip 29, there are arranged air-permeable solid walls 27 between the furnace wall 28*a* and the strip 29 and between the furnace wall 28*c* and the strip 29. In this embodiment, the strip 29 is heated by the solid radiation from the air-permeable solid walls instead of the solid radiation from the peripheral wall of the furnace, so the transfer heat quantity can be increased.

Figure 13:
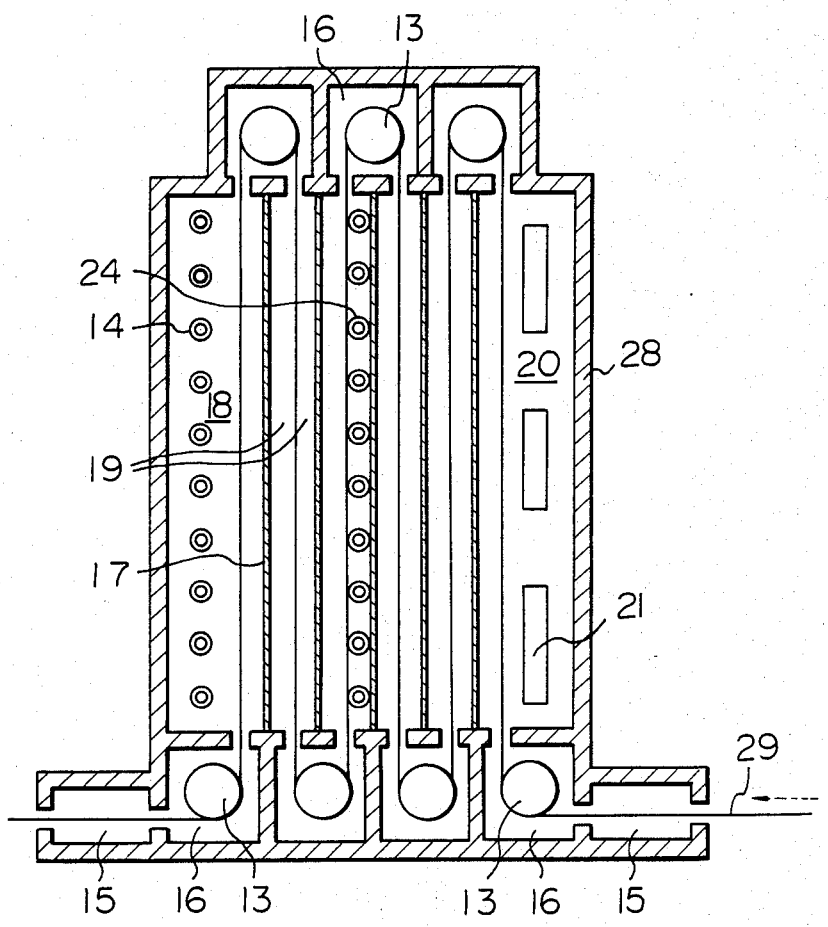
Figure 14:
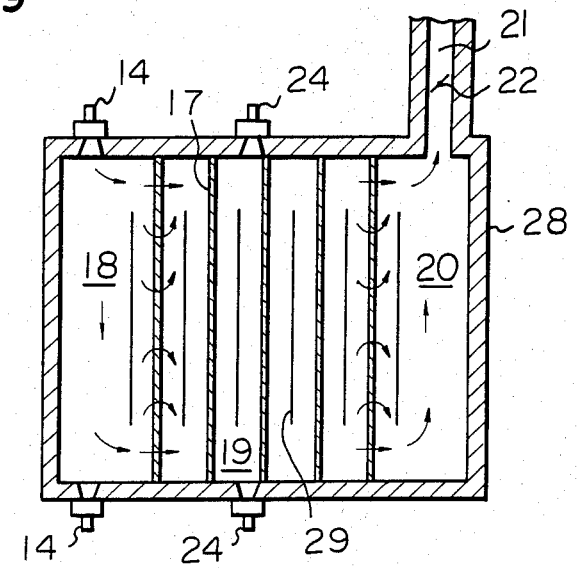

In the embodiment illustrated in FIGS. 13 and 14, a combustion gas supply device 24 is arranged in an intermediate portion between the strip 29 and the air-permeable solid wall 17 (in the heating chamber), and the temperature of the combustion gas in the heating chamber 19 can be maintained at a high level. In this embodiment, a heat treatment burner may be used as the gas supply device 24 as well as the combustion gas supply device 14 arranged in the combustion chamber 18, or a gas formed by combustion outside the furnace may be supplied.

In the embodiment shown in FIGS. 13 and 14, an air supply device is arranged instead of the combustion gas supply device 24 arranged in the heating chamber, and the unburnt component-containing combustion gas flowing from the upstream side is subjected to secondary combustion to maintain the temperature of the combustion gas in the heating chamber 19 at a high level.

Figure 16:
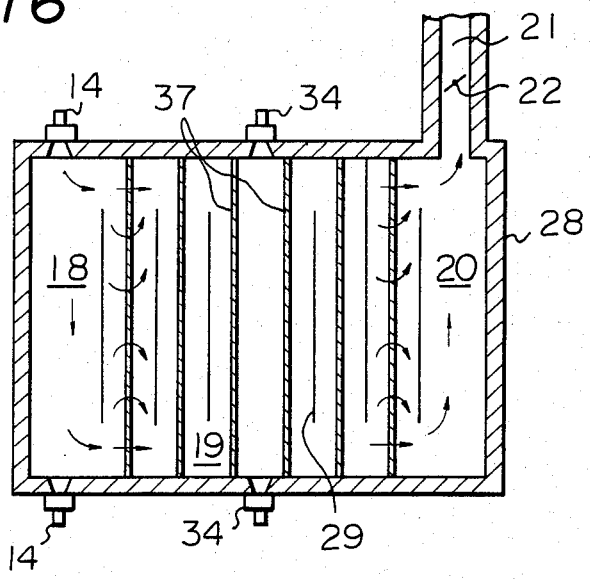
Figure 15:
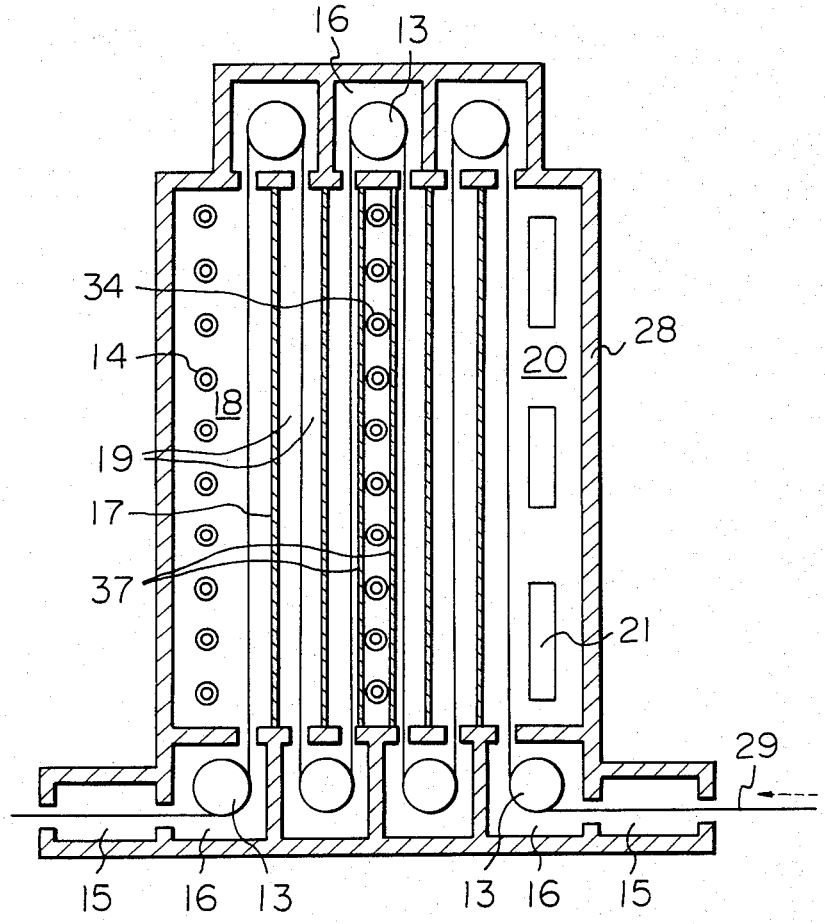

In the embodiment illustrated in FIGS. 15 and 16, a plurality (two lines in the drawings) of air-permeable solid walls 37 are arranged at least in a part between the confronting surfaces of the strip 29 or between the confronting surfaces of the strip 29 and the furnace wall. In this embodiment, if necessary, a combustion gas supply device 34 or air supply device may be arranged between two lines of the air-permeable solid walls 37. In this embodiment, the space between the air-permeable solid walls 37 is isolated from the strip 29 as the combustion reaction chamber. By utilizing the porosity of the air-permeable solid, the combustion reaction is promoted. Since a homogeneous atmosphere (combustion gas) is maintained on the surface of the strip 29, the quality of the strip can be improved.

Figure 17:
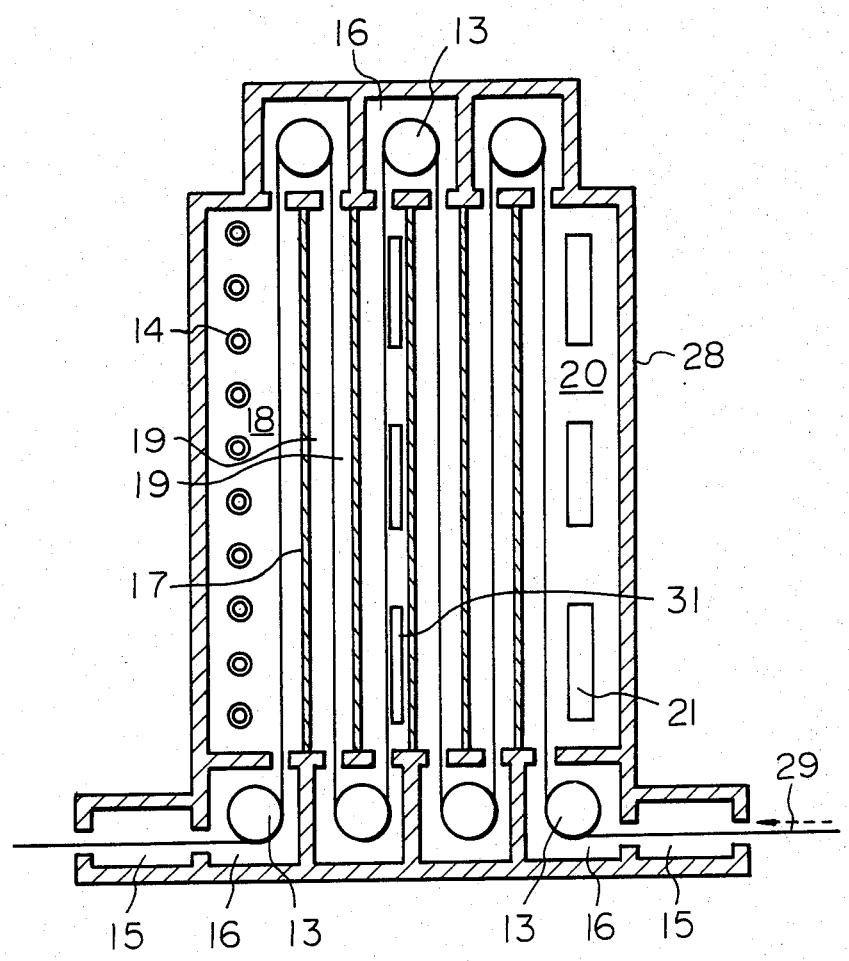
Figure 18:
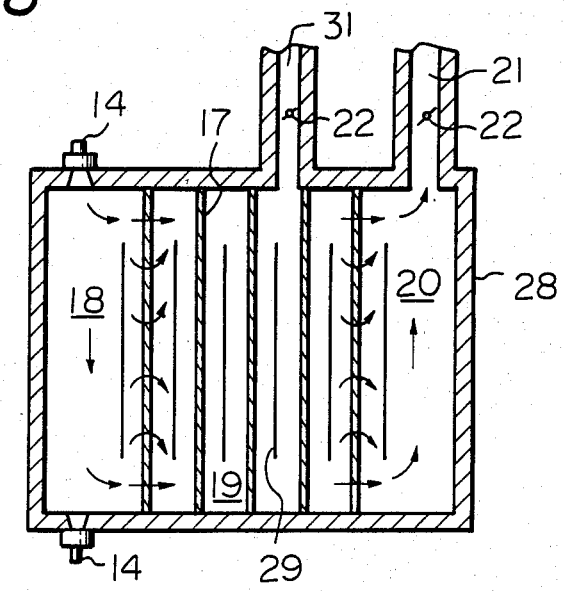
Figure 20:
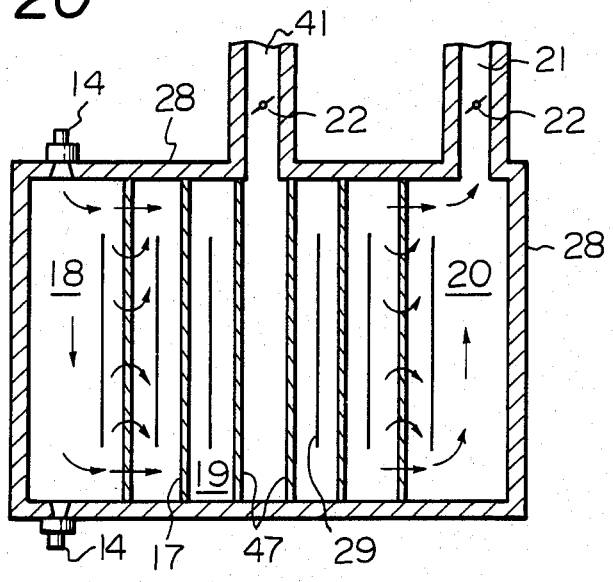
Figure 19:
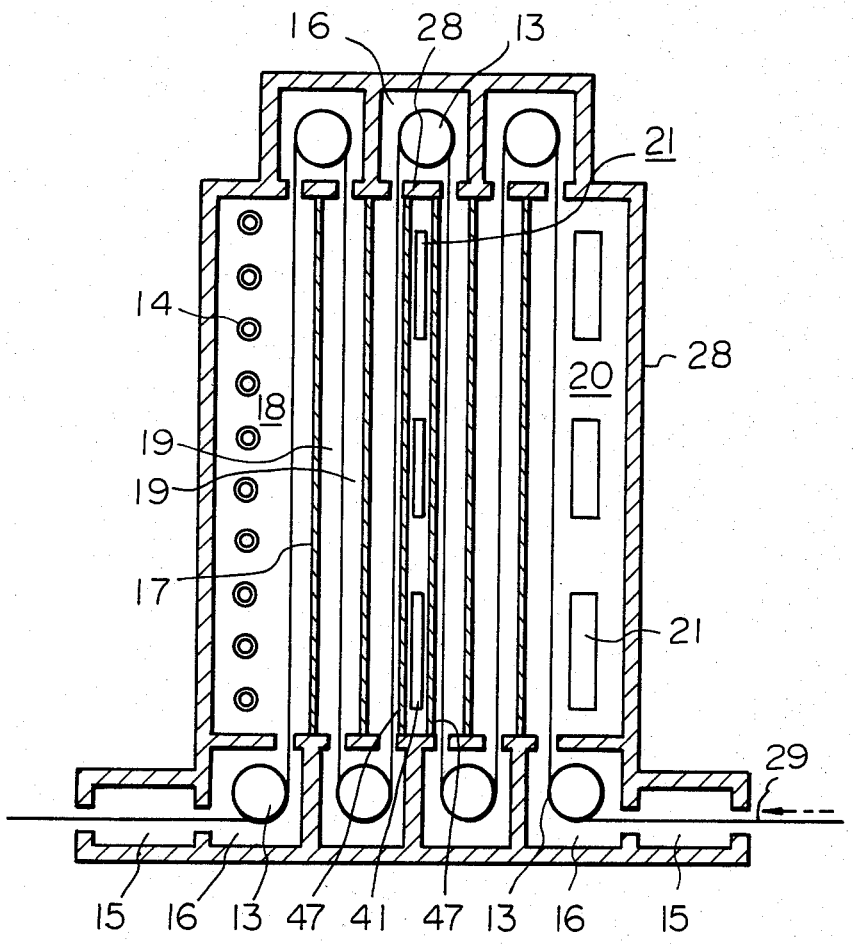

In the embodiment illustrated in FIGS. 17 and 18, a flue 31 for discharging the combustion gas is arranged in the intermediate portion between the strip 29 and the air-permeable solid wall 17. Furthermore, there may be adopted a modification in which two lines of air-permeable solid walls 47 are arranged between the confronting surfaces of the strip 29 and a combustion gas discharge flue 41 is formed in the intermediate portion between the two walls 47, as shown in FIGS. 19 and 20.

If this structure is adopted, the treatment capacity of the furnace can be increased. Namely, the adjustment of the pressure loss in the furnace can be facilitated because of increase of the quantity of the required gas.

Figure 21:
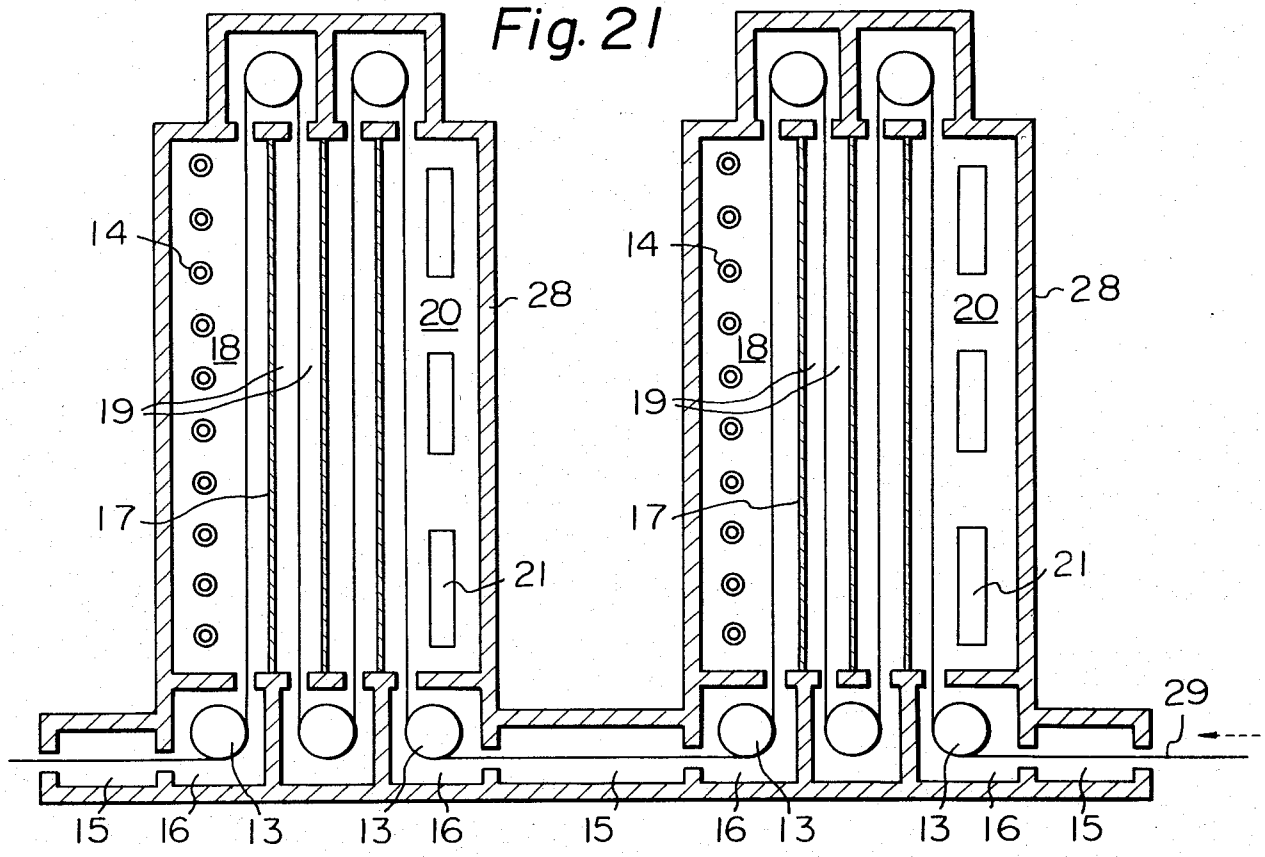
FIGS. 21 and 22 are longitudinal sectional views of examples of the arrangement of the heat treatment furnace of the present invention.

In the embodiment illustrated in FIG. 21, the basic vertical furnace of the present invention is used as one unit, and a plurality of such units are arranged and connected in series to one another. If this arrangement is adopted, maintenance of the temperature of the combustion gas in the heating chamber 19 and adjustment of the furnace pressure (pressure loss) can be facilitated.

Figure 22:
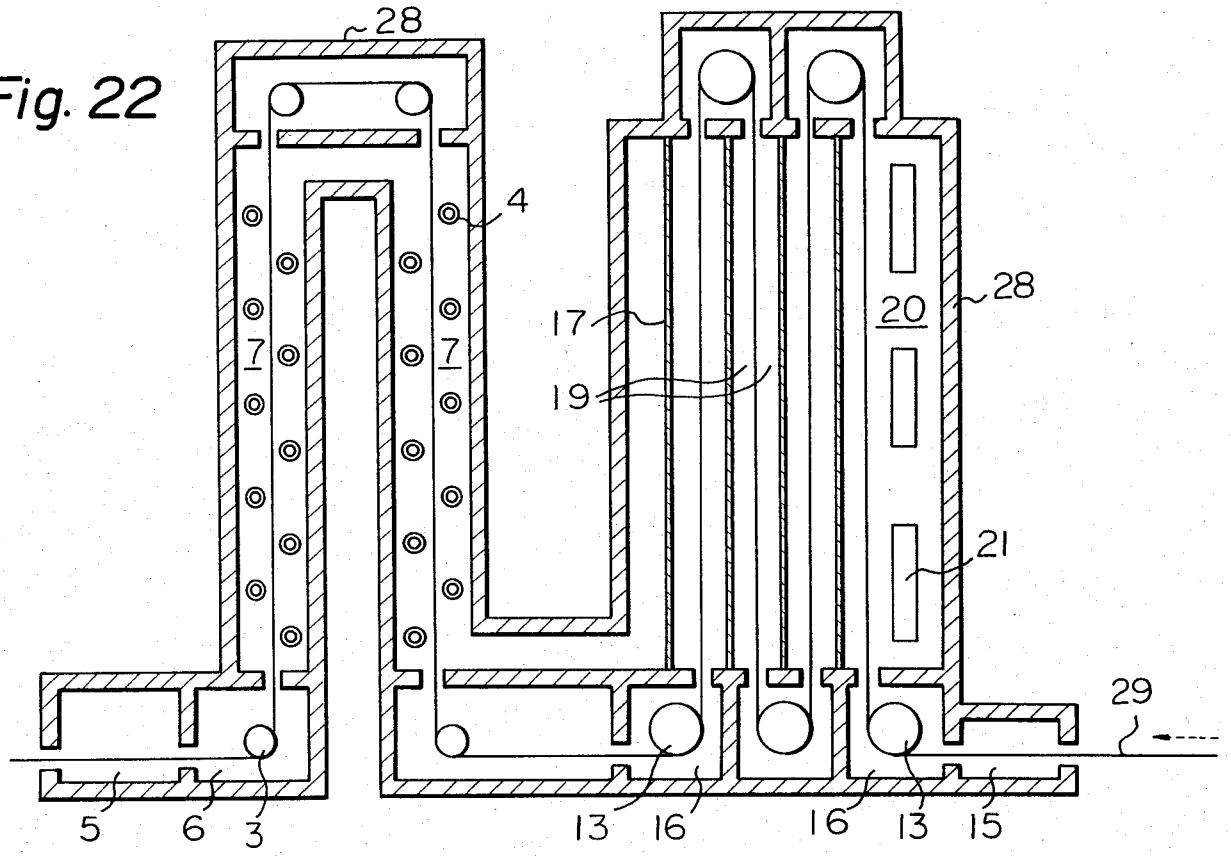

In the embodiment illustrated in FIG. 22, conventional NOF is connected to the outlet side (high temperature side) of the vertical heat treatment furnace of the present invention, and the exhaust combustion gas from the conventional NOF is used as the heating gas. Since this corresponds to substitution of the preheating chamber of the conventional NOF, the preheating chamber can be made compact.

As will readily be understood from the foregoing description, according to the present invention, an air-permeable solid wall having a heat transfer-promoting effect and a gas-commutating effect is arranged between the confronting surfaces of a strip and a combustion gas is caused to flow vertically to the strip and the air-permeable solid wall. By dint of these characteristic features, in the vertical continuous heat treatment furnace for strips according to the present invention, the heat transfer efficiency and heating efficiency can be improved over those attainable in the conventional vertical continuous heat treatment furnace. Accordingly, at the same heating T/H, the path number can be reduced or the exhaust gas temperature can be lowered. Moreover, since the air-permeable solid has a good heat response, severe temperature control can easily be accomplished at the time of exchange of strips to be heated. Still further, since the furnace length can be shortened and the wall surface area of the furnace can be reduced, the equipment cost can be reduced. Accordingly, the present invention is industrially advantageous in various points.

We claim:

1. A continuous heat treatment furnace for heat-treating a metal strip comprising outer furnace walls defining said furnace, roller means disposed within the interior of said furnace providing a plurality of adjacent paths within said furnace interior for passing said metal strip through said furnace, a separation wall of an air-permeable solid having a three-dimensional skeleton structure or net-like laminate structure disposed within the interior of said furnace, and satisfying the following requirement:

$$\frac{10}{a_p} < \delta < 300000 \frac{\epsilon^3}{a_p^2}$$

wherein $\delta$ stands for the thickness (m) of the air-permeable solid wall, $a_p$ stands for the specific surface area ($m^2/m^3$) of the air-permeable solid wall, and $\epsilon$ stands for a porosity of the air-permeable solid wall, and wherein said separation wall is arranged between the confronting surfaces of the strip passing in two adjacent paths.

2. A heat treatment furnace according to claim 1 having a strip introduction side and a strip discharge side;

a first chamber located at said strip introduction side;

combustion gas discharge flue means communicating with said first chamber;

a second chamber located at said strip discharge side; and combustion gas supply means communicating with said second chamber.

3. A heat treatment furnace according to claim 2 further including:

beams formed from heat resistant supporting members disposed between adjacent strip paths wherein said beams are spaced at intervals in the strip-advancing direction;

rod shaped protector members having heat resistant strength disposed between adjacent beams and spaced at intervals transverse to the strip advancing direction; and frame members mounted on said heat resistant supporting members and said protector members receiving said air permeable solid separation wall.

4. A heat treatment furnace according to claim 3 wherein said heat resistant supporting members include conduit means for transporting a cooling gas and said furnace further comprises means for feeding and cooling gas discharged from said conduit means to said combustion gas supply means.

5. A heat treatment furnace according to claim 2 further comprising additional combustion gas supply means disposed between one strip path and the adjacent air-permeable solid separation wall.

6. A heat treatment furnace according to claim 2 further including additional combustion gas discharge flue means disposed between one strip path and the adjacent air-permeable solid separation wall.

7. A heat treatment furnace according to claim 1 further comprising an additional air-permeable solid separation wall arranged between the outer furnace wall and the confronting surface of the strip passing in the adjacent strip path.

8. A heat treatment furnace according to claim 7 further comprising a plurality of rows of air-permeable solid walls arranged between the outer furnace wall and the confronting surface of the strip passing in the adjacent strip path.

9. A heat treatment furnace according to claim 8 further including a combustion gas supply means disposed between rows of said air-permeable solid walls.

10. A heat treatment furnace according to claim 1 further comprising a plurality of rows of air-permeable solid walls disposed between confronting surfaces of the strip passing in two adjacent strip paths.

11. A heat treatment furnace according to claim 10 further including a combustion gas supply means disposed between rows of said air-permeable solid walls.

* * * * *